US008360417B2

(12) United States Patent
Goh et al.

(10) Patent No.: US 8,360,417 B2
(45) Date of Patent: Jan. 29, 2013

(54) INPUT TRAY MEDIA DE-SLOUCH SYSTEM

(75) Inventors: Eng Long Goh, San Diego, CA (US); Mark Sutherland, San Diego, CA (US); Minh Duong, San Diego, CA (US); Danny Codd, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2360 days.

(21) Appl. No.: 11/047,040

(22) Filed: Jan. 31, 2005

(65) Prior Publication Data

US 2006/0170148 A1 Aug. 3, 2006

(51) Int. Cl.
*B65H 1/02* (2006.01)
*B65H 3/34* (2006.01)

(52) U.S. Cl. ..... 271/149; 271/145; 271/167

(58) Field of Classification Search ..... 271/145, 271/147, 157, 149, 167, 121, 117, 104; 347/104
See application file for complete search history.

(56) References Cited

U.S. PATENT DOCUMENTS

| | | | | |
|---|---|---|---|---|
| 2,863,662 | A * | 12/1958 | Fiehl | 271/166 |
| 5,114,133 | A | 5/1992 | Osada et al. | |
| 5,227,004 | A * | 7/1993 | Belger | 156/552 |
| 5,615,874 | A | 4/1997 | Parthasarathy et al. | |
| 5,961,112 | A * | 10/1999 | Kim | 271/10.05 |
| 6,009,302 | A | 12/1999 | Worley et al. | |
| 6,102,509 | A | 8/2000 | Olson | |
| 6,116,589 | A | 9/2000 | Bortolotti | |
| 6,167,232 | A | 12/2000 | Jimenez et al. | |
| 6,199,855 | B1 | 3/2001 | Choeng et al. | |
| 6,217,017 | B1 | 4/2001 | Yamazaki | |
| 6,352,256 | B1 | 3/2002 | Hsieh | |
| 6,382,621 | B1 * | 5/2002 | Inoue et al. | 271/120 |
| 6,651,973 | B2 | 11/2003 | Gaarder et al. | |
| 6,764,072 | B2 | 7/2004 | Gaarder | |
| 7,021,185 | B2 * | 4/2006 | Cote et al. | 83/268 |
| 7,131,644 | B2 * | 11/2006 | Williamson et al. | 271/121 |
| 7,172,192 | B2 * | 2/2007 | Mitsuhashi | 271/121 |
| 2001/0052921 | A1 * | 12/2001 | Kabamoto | 347/104 |
| 2003/0184003 | A1 * | 10/2003 | Asada et al. | 271/121 |
| 2004/0017039 | A1 | 1/2004 | Asada et al. | |
| 2004/0041332 | A1 | 3/2004 | Kamimura et al. | |

FOREIGN PATENT DOCUMENTS

| | | | |
|---|---|---|---|
| JP | 06191656 | * | 7/1994 |

* cited by examiner

*Primary Examiner* — Patrick Cicchino

(57) ABSTRACT

This invention relates to an input tray media de-slouch apparatus, comprising; an input media tray, at least one pivotable media de-slouch arm operatively connected to the tray, and a releasable locking means operatively connected to the arm and the tray to lock the arm prior to media being placed against the arm to substantially keep the media from slouching and to release the arm when the media is being fed from the input tray.

7 Claims, 3 Drawing Sheets

INPUT TRAY MEDIA DE-SLOUCH SYSTEM

BACKGROUND OF THE INVENTION

1. Field of the Invention

This invention relates to an input tray media de-slouch apparatus, comprising; an input media tray, at least one pivotable media de-slouch arm operatively connected to the tray, and a releasable locking means operatively connected to the arm and the tray to lock the arm prior to media being placed against the arm to substantially keep the media from slouching and to release the arm prior to the media being fed from the input tray.

2. Description of the Related Art

Prior to the present invention, as set forth in general terms above and more specifically below, it is known in rear and vertically loaded printer media trays that slouching of stiff media is to be avoided. Slouching is defined as having the media fan out, slip down the tray floor, or worse, sliding into the printer media feed system, thereby causing jams. In prior rear and vertically loaded printer media trays, a stationary friction pad was mounted on the tray floor. The pad was used to achieve the dual purposes of preventing media movement during loading and also providing separation forces for preventing multi-picking of the media during the pick cycle. Multi-picking results when the top sheet the media tends to drag the sheet of media below it into the media handling feed mechanism, due to friction.

One major drawback of this design is the limited effectiveness of the friction pad in preventing media movement during the loading process. This is because increasing the frictional forces while achieving limited media movement during the loading process would result in no pick of media and a subsequent increase in system torque requirements. Consequently, a more advantageous system, then, would be provided if media slouching could be eliminated while reducing multi-picking of the media.

It is apparent from the above that there exists a need in the art for an input tray media system that is capable of eliminating media slouching while reducing multi-picking of the media. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing an input tray media de-slouch apparatus, comprising; an input media tray, at least one pivotable media de-slouch arm operatively connected to the tray, and a releasable locking means operatively connected to the arm and the tray to lock the arm prior to media being placed against the arm to substantially keep the media from slouching and to release the arm prior to the media being fed from the input tray.

In certain preferred embodiments, the arm further includes a textured surface. Also, the releasable locking means is further comprised of a pick arm, a de-slouch linkage, a de-slouch spring, a de-slouch latch, and drive gears.

In another further preferred embodiment, an input tray media system is utilized that is capable of eliminating media slouching while reducing multi-picking of the media through the use of pivotable de-slouch arms and a releasable locking means operatively connected to the arm.

The preferred input tray media system, according to various embodiments of the present invention, offers the following advantages: ease-of-use; lightness in weight; ease of assembly and repair; excellent de-slouching characteristics; reduced probability of multi-picking when the media is initially installed; good durability; and good economy. In fact, in many of the preferred embodiments, these factors of ease-of-use, excellent de-slouching characteristics, and reduced multi-picking are optimized to an extent that is considerably higher than heretofore achieved in prior, known.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
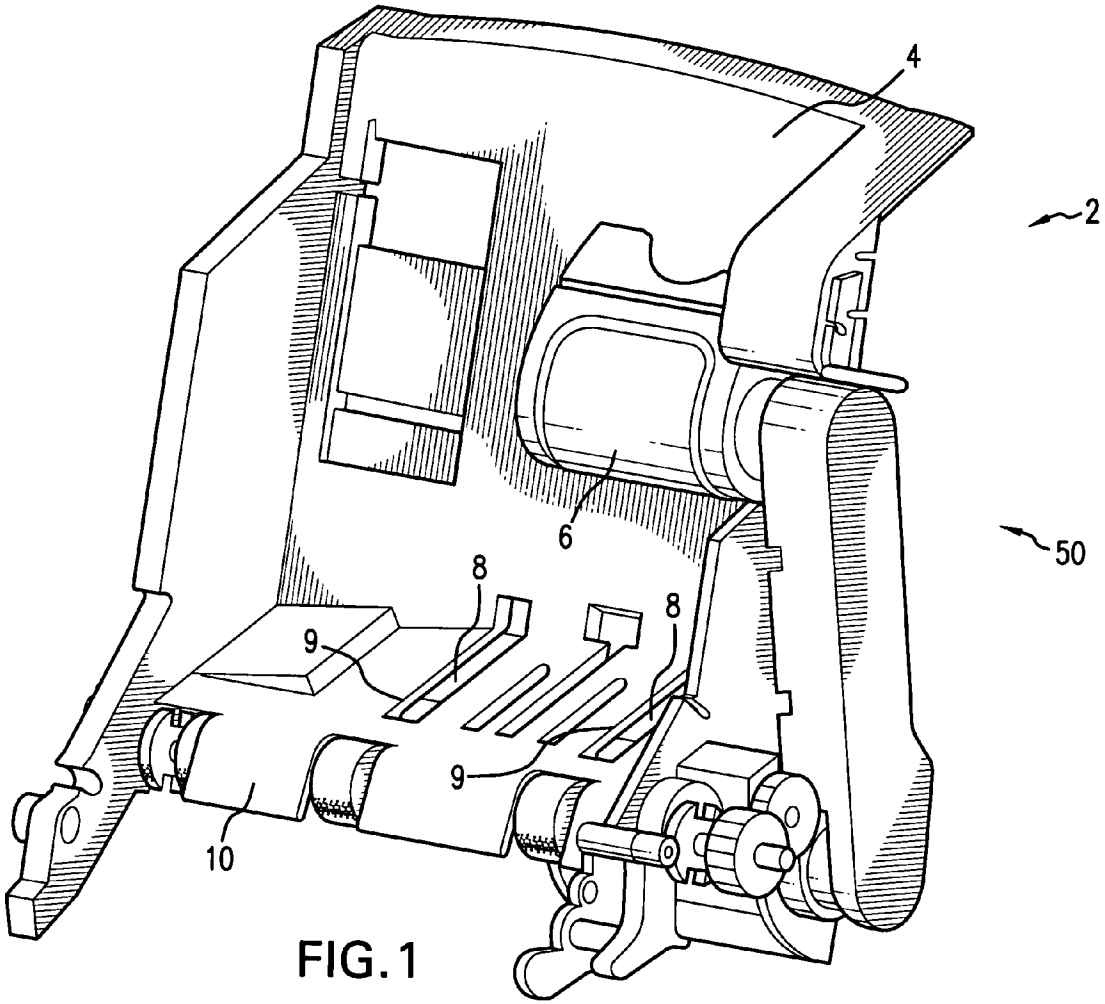
FIG. 1 is an isometric, front view of an input tray media de-slouch system, according to one embodiment of the present invention.

With reference first to FIG. 1, there is illustrated one preferred embodiment for use of the concepts of this invention. FIG. 1 illustrates an input tray media de-slouch system 2. System 2 includes, in part, input tray 4 having media leading edge abutment side 10, pick roller cover 6, pivotable de-slouch arms 8, slots 9, and remaining de-slouch assembly 50. Tray 4, pick roller cover 6, arms 8, and assembly 50, preferably, are constructed of any suitable, durable material that is capable of handling a variety of media, particularly thick media such as photo media. As can be seen in FIG. 1, pick roller cover 6 is located substantially above pivotable de-slouch arms 8. Also, pivotable de-slouch arms 8 are located substantially within slots 9 formed within media leading edge abutment side 10.

Figure 2:
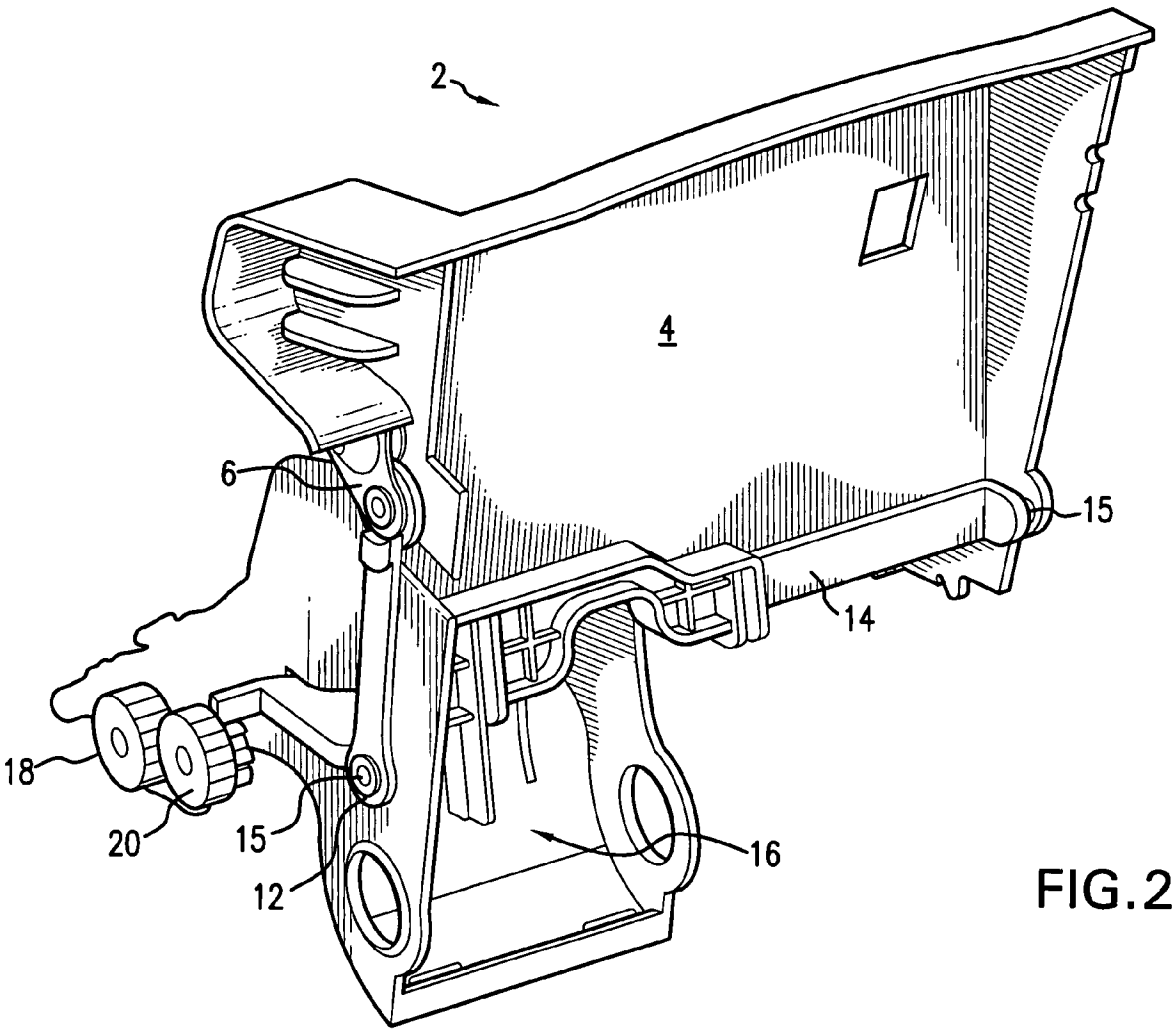
FIG. 2 is an isometric, rear view of the input tray media de-slouch system, according to another embodiment of the present invention.

With respect to FIG. 2, the rearview of input tray media de-slouch system 2 is illustrated. System 2 further includes, in part, de-slouch linkage 12, pivotable de-slouch arm support 14, pivotable de-slouch arm support pivot 15, latch 16, intermediate drive gear 18, and cam gear 20. Linkage 12, support 14, pivot 15, latch 16, drive gear 18, and cam gear 20 are, preferably, constructed of any suitable, durable material that is capable of handling a variety of media, particularly thick media such as photo media. As can be seen in FIG. 2, support 14 is releasably attached to latch 16. Also, support 14 is pivotally connected to tray 4 at pivots 15. Also, pick roller cover 6 is pivotally attached to de-slouch linkage 12. De-slouch linkage 12 is pivotally attached to de-slouch arm support 14. Finally, latch 16 is operatively connected to cam gear 20.

Figure 3:
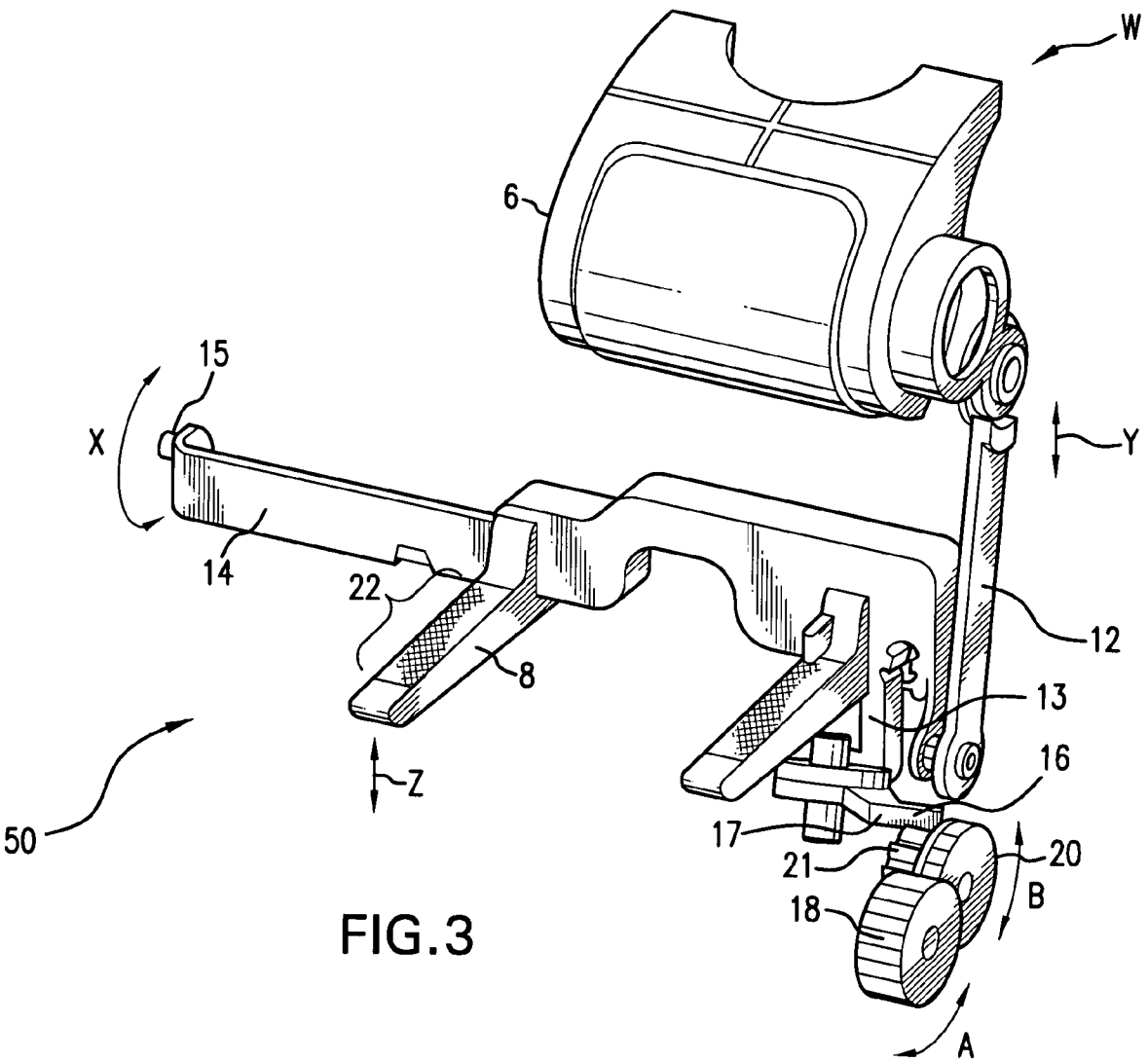
FIG. 3 is an isometric view of a de-slouch assembly, according to another embodiment of the present invention.

With respect to FIG. 3, assembly 50 is further illustrated. Assembly 50 includes, in part, pick roller cover 6, pivotable de-slouch arms 8, de-slouch linkage 12, pivotable de-slouch support extension 13, pivotable de-slouch arm support 14, pivotable de-slouch arm support pivot 15, latch 16, latch arm 17, intermediate drive gear 18, cam gear 20, cam gear slot 21, and pivotable de-slouch arm surface 22. Preferably, surface 22, is constructed to create a roughened texture, such as through the use of serrations or other suitable raised textures. Surface 22 is used in conjunction with arms 8 in order to prevent the slouching of the media by providing a roughened surface which contacts the leading edge of the media. It is to be understood that the roughened surface 22 may also be a serrated-surface with rearwards (back of input tray 4) facing teeth, to positively lock the media and prevent it from slouching.

With respect to FIGS. 1-3, during the operation of input tray media de-slouch system 2 and assembly 50, the user pulls down on pick roller cover 6 (in the direction of arrow W) to create an opening to deposit a stack of media (not shown). This pulling motion actuates linkage 12 (along the direction of arrow Y) which causes support 14 to rotate (along the clockwise direction of arrows X) and raise de-slouch arms 8 (along the upward direction of arrows Z) above side 10. Once arms 8 are raised, they are locked into position by the interaction between support extension 13 and latch 16. In this position, any amount of media re-straightening by the user will be encountered by the raised position of the de-slouch arms 8, as well as surface 22 of arm 8. Consequently, the user will be satisfied that the media is loaded correctly. Preferably, the arms 8 are locked in a position at angle that is less than 90° with respect to tray 4.

When system 2 is powered up, intermediate drive gear 18 rotates (in the direction of arrow A) with earn gear 20 which in turn interacts (along the direction of arrow B) with latch in 17. This causes latch 16 to become disengaged from support extension 13. Once support extension 13 is disengaged from latch 16, de-slouch arms 8 pivot (along the downward direction of arrows Z) towards side 10. This rotation of arms K (along the counterclockwise direction of arrows X) causes the media to contact side 10 for subsequent media picking and further media processing. This operation would repeat itself any time media is loaded into system 2. It is to be understood that if the dc-slouch system 2 is activated with media already present in the input tray 4, the de-slouch arms 8 will serve to "straighten" the media and reverse any slouching/fanning already present in the media stack. This effect is more pronounced with a large activation angle of the de-slouch arms 8, and a low pick tire X-position, effectively squeezing the stack hack in place (i.e. activated de-slouch arm-to-input tray rear wall angle of<80 degrees or so).

Also, the present invention can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In preferred embodiments, the present invention can be implemented in a combination of software and data executed and stored under the control of a computing device.

It will be well understood by one having ordinary skill in the art, after having become familiar with the teachings of the present invention, that software applications may be written in a number of programming languages now known or later developed.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. An input tray media de-slouch apparatus, comprising:

an input media tray including a media leading edge abutment side having at least one slot formed therein;

at least one pivotable media de-slouch arm operatively connected to the tray and located within the at least one slot;

an arm support operatively connected to the arm;

a pick roller cover operatively associated with the tray;

a linkage operatively connected to the pick roller cover and the arm; and a releasable locking means operatively connected to the arm and the tray to lock the arm prior to media being placed against the arm to substantially keep the media from slouching and to release the arm prior to the media being fed from the tray, wherein pivoting the pick roller cover actuates the linkage which in turn rotates the arm support and raises the arm above the media leading edge abutment side, wherein the locking means locks the arm at an angle with respect to the media leading edge abutment side.

2. The apparatus, as in claim 1, wherein the at least one slot formed in the media leading edge abutment side of the input media tray comprises two spaced slots, and wherein the at least one pivotable media de-slouch arm comprises two spaced pivotable media de-slouch arms each located within a corresponding one of the two spaced slots.

3. The apparatus, as in claim 1, wherein the arm support is further comprised of:

a pivotable de-slouch support extension operatively connected to the support and the locking means.

4. The apparatus, as in claim 1, wherein the pivotable media de-slouch arm is further comprised of:

a textured surface located substantially along a portion of the arm.

5. The apparatus, as in claim 1, wherein the locking means is further comprised of:

a latch operatively connected to the arm; and a drive means to operate the latch.

6. The apparatus, as in claim 5, wherein the drive means is further comprised of:

an intermediate drive gear; and a cam gear operatively connected to the drive gear and a latch arm of the latch.

7. The apparatus, as in claim 6, wherein rotating the intermediate drive gear rotates the cam gear which in turn interacts with the latch arm to disengage the latch and pivot the arm toward the media leading edge abutment side such that the media contacts the media leading edge abutment side.

* * * * *